US011271293B2

(12) United States Patent
Yoshioka

(10) Patent No.: US 11,271,293 B2
(45) Date of Patent: Mar. 8, 2022

(54) ANTENNA DEVICE

(71) Applicant: Hiroki Yoshioka, Kawasaki (JP)

(72) Inventor: Hiroki Yoshioka, Kawasaki (JP)

(73) Assignee: MITSUMI ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/889,923

(22) Filed: Jun. 2, 2020

(65) Prior Publication Data

US 2020/0388909 A1 Dec. 10, 2020

(30) Foreign Application Priority Data

Jun. 5, 2019 (JP) ..... JP2019-105336

(51) Int. Cl.

| | |
|---|---|
| ***H01Q 1/32*** | (2006.01) |
| ***H01Q 9/04*** | (2006.01) |
| ***H01Q 9/28*** | (2006.01) |
| ***H01Q 21/28*** | (2006.01) |
| ***H01Q 19/30*** | (2006.01) |
| ***H01Q 9/18*** | (2006.01) |

(52) U.S. Cl.

CPC ..... *H01Q 1/3275* (2013.01); *H01Q 9/045* (2013.01); *H01Q 9/0435* (2013.01); *H01Q 9/18* (2013.01); *H01Q 9/285* (2013.01); *H01Q 19/30* (2013.01); *H01Q 21/28* (2013.01)

(58) Field of Classification Search

CPC ..... H01Q 1/32; H01Q 1/3208; H01Q 1/3216; H01Q 1/325; H01Q 1/3275; H01Q 9/0435; H01Q 9/045; H01Q 9/16; H01Q 9/18; H01Q 9/20; H01Q 9/22; H01Q 9/26; H01Q 9/265; H01Q 9/27; H01Q 9/28; H01Q 9/285; H01Q 19/30; H01Q 21/12; H01Q 21/28; H01Q 21/062

See application file for complete search history.

(56) References Cited

U.S. PATENT DOCUMENTS

| | | | | |
|---|---|---|---|---|
| 9,300,053 | B2 | 3/2016 | Wunsch et al. | |
| 2010/0103050 | A1 | 4/2010 | Shimizu | |
| 2015/0061946 | A1 | 3/2015 | Martinez et al. | |
| 2020/0091615 | A1 * | 3/2020 | Sone | H01Q 21/29 |

FOREIGN PATENT DOCUMENTS

| | | | |
|---|---|---|---|
| EP | 2833479 | A1 | 2/2015 |
| JP | 2018182722 | A | 11/2018 |

OTHER PUBLICATIONS

Extended European Search Report (EESR) dated Oct. 21, 2020 issued in European Application No. 20178506.0.

* cited by examiner

*Primary Examiner* — Robert Karacsony
(74) *Attorney, Agent, or Firm* — Holtz, Holtz & Volek PC

(57) ABSTRACT

An antenna device installed in a vehicle includes a stacked dipole antenna unit. The stacked dipole antenna unit has a plurality of dipole antennas that are arranged parallel to a plane perpendicular to a front-back direction of the vehicle.

7 Claims, 11 Drawing Sheets

| MODEL | STACKED DIPOLE ANTENNA DISTANCE D = 5 mm D=5 | STACKED DIPOLE ANTENNA DISTANCE D = 10 mm D=10 | STACKED DIPOLE ANTENNA DISTANCE D = 15 mm D=15 |
|---|---|---|---|
| HORIZONTAL RADIATION PATTERN |  |  |  |
| AVERAGE GAIN [dBi] | 0.9 | 0.9 | 1.1 |
| GAIN IN 0° DIRECTION [dBi] | 1.0 | 1.7 | 2.9 |
| GAIN IN 90° DIRECTION [dBi] | 0.6 | −0.2 | −1.6 |

| | | |
|---|---|---|
| MODEL | SUBSTRATE-STACKED DIPOLE ANTENNA<br>HEIGHT h=20mm, DISTANCE D=10mm<br>  | MONOPOLE ANTENNA<br>  |
| HORIZONTAL RADIATION PATTERN |  |  |
| AVERAGE GAIN [dBi] | 1.8 | -1.0 |
| GAIN IN 0° DIRECTION [dBi] | 2.8 | -1.0 |
| GAIN IN 90° DIRECTION [dBi] | 0.9 | -1.0 |
| GAIN IN 180° DIRECTION [dBi] | 2.1 | -1.0 |
| VERTICAL PLANE RADIATION PATTERN |  |  |

| MODEL | SUBSTRATE-STACKED DIPOLE ANTENNA + WAVE DIRECTOR, LENGTH RL=13 mm   | SUBSTRATE-STACKED DIPOLE ANTENNA + WAVE DIRECTOR, LENGTH RL=15 mm   | SUBSTRATE-STACKED DIPOLE ANTENNA + WAVE DIRECTOR, LENGTH RL=17 mm   |
|---|---|---|---|
| HORIZONTAL RADIATION PATTERN |   |   |   |
| AVERAGE GAIN [dBi] | 2.0 | 2.0 | 1.9 |
| GAIN IN 0° DIRECTION [dBi] | 4.0 | 4.6 | 5.3 |
| GAIN IN 90° DIRECTION [dBi] | 0.5 | 0.1 | -2.2 |
| GAIN IN 180° DIRECTION [dBi] | 1.9 | 1.6 | 2.1 |

| MODEL | SUBSTRATE-STACKED DIPOLE ANTENNA + WAVE DIRECTOR, LENGTH RL=13 mm   | SUBSTRATE-STACKED DIPOLE ANTENNA + WAVE DIRECTOR, LENGTH RL=15 mm   | SUBSTRATE-STACKED DIPOLE ANTENNA + WAVE DIRECTOR, LENGTH RL=17 mm   |
|---|---|---|---|
| HORIZONTAL RADIATION PATTERN |   |   |   |
| AVERAGE GAIN [dBi] | 2.0 | 2.0 | 2.0 |
| GAIN IN 0° DIRECTION [dBi] | 2.5 | 2.5 | 2.9 |
| GAIN IN 90° DIRECTION [dBi] | 0.6 | 0.0 | -1.8 |
| GAIN IN 180° DIRECTION [dBi] | 3.5 | 4.1 | 5.0 |

ANTENNA DEVICE

CROSS-REFERENCE TO RELATED APPLICATIONS

The entire disclosure of Japanese Patent Application No. 2019-105336 filed on Jun. 5, 2019 is incorporated herein by reference in its entirety.

BACKGROUND

Technological Field

The present invention relates to an antenna device.

Description of the Related Art

Conventionally, there is known an in-vehicle antenna device installed on a roof of a vehicle such as a motor vehicle and receiving radio waves of a wireless communication system (standard) such as GPS (Global Positioning System), satellite radio broadcasting, and AM/FM radio broadcasting. A fixing unit provided on a bottom surface of the antenna device is inserted into a roof hole for fixing (fixing opening) formed on an installation surface of a roof of the vehicle, such that the antenna device is appropriately fixed on the installation surface.

As a wireless communication system of the above in-vehicle antenna device, V2X (Vehicle to everything) is known to perform communication between a motor vehicle and an object. The V2X is a general term incorporating the followings as communication systems: V2N (Vehicle to cellular Network) that uses a communication standard such as 3G (Generation) and LTE (Long Term Evolution); V2V (Vehicle to Vehicle) that performs communication between motor vehicles (inter-vehicle communication); and V2I (Vehicle to roadside Infrastructure) that performs communication between the motor vehicle and a corresponding device(s) on the road (road-to-vehicle communication).

There is known an antenna device including a monopole antenna for V2X communication as the in-vehicle antenna device. The monopole antenna can reduce the size (height) of the antenna device and can be used in combination with other media antennas for satellite radio broadcasting (such as a patch antenna) and the like. However, a monopole antenna is susceptible to other media antennas.

Therefore, according to the technique in JP 2018-182722 A, a V2X antenna device includes a sleeve antenna having an erected antenna substrate with patterned conductive wire, an antenna for satellite radio broadcasting, and an antenna for GPS.

In V2X communication, communication in the front and back directions of the vehicle are important for V2V communication. For example, a vehicle appropriately performs processing to prevent an accident in response to receiving information on sudden braking of a vehicle in front in V2V communication. However, since a monopole antenna tends to have directivity pointing upward from the horizontal plane, its gain in the front-rear direction of the vehicle is likely to be reduced when the monopole antenna is installed in a vehicle. Furthermore, a sleeve antenna is hardly susceptible to other media antennas, but is desired to have more gain in the front-rear direction of the vehicle.

SUMMARY

An object of the present invention is to increase the gain in the front-rear direction of the vehicle.

In order to solve the above problems, according to an aspect of the present invention, there is provided an antenna device installable in a vehicle, including:

a stacked dipole antenna unit that has a plurality of dipole antennas arranged parallel to a plane perpendicular to a front-back direction of the vehicle.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment and first and second modified examples of the present invention will be described in detail with reference to the attached drawings. However, the scope of the invention is not limited to them.

Embodiment

Figure 1A:
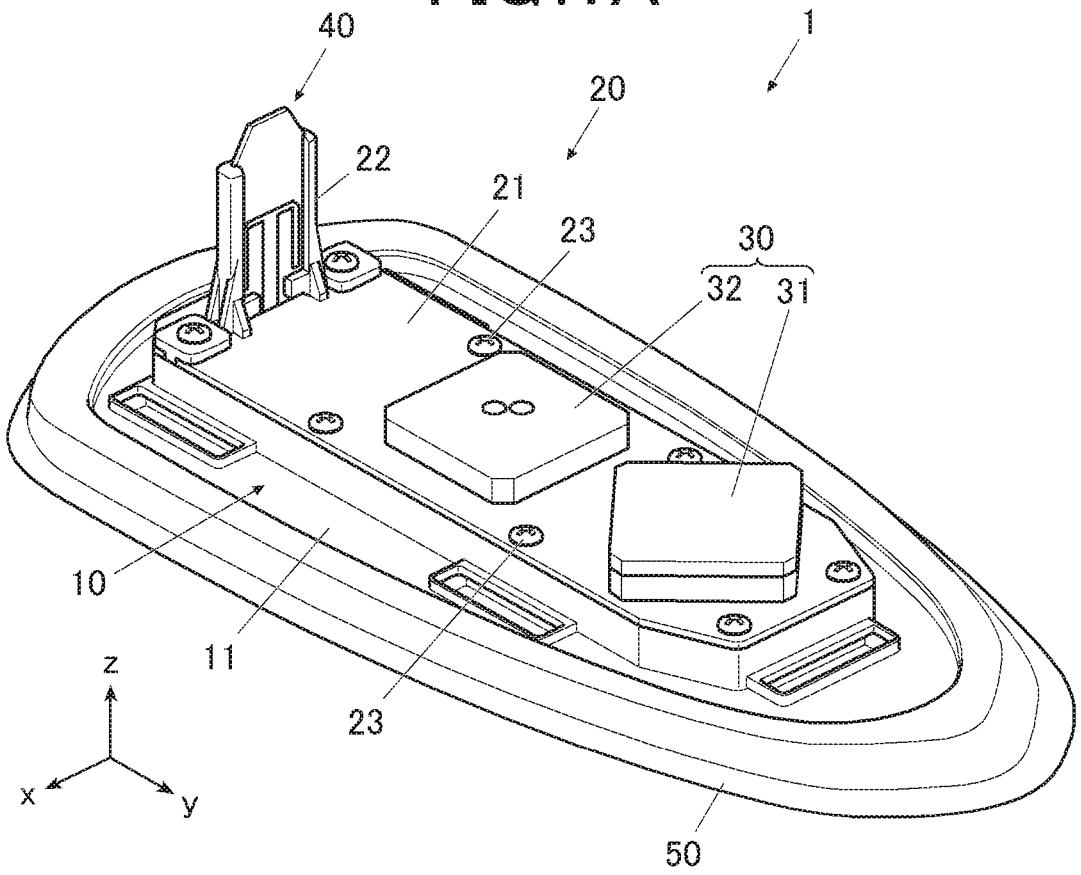
FIG. 1A is a perspective view showing an antenna device according to an embodiment of the present invention.
Figure 1B:
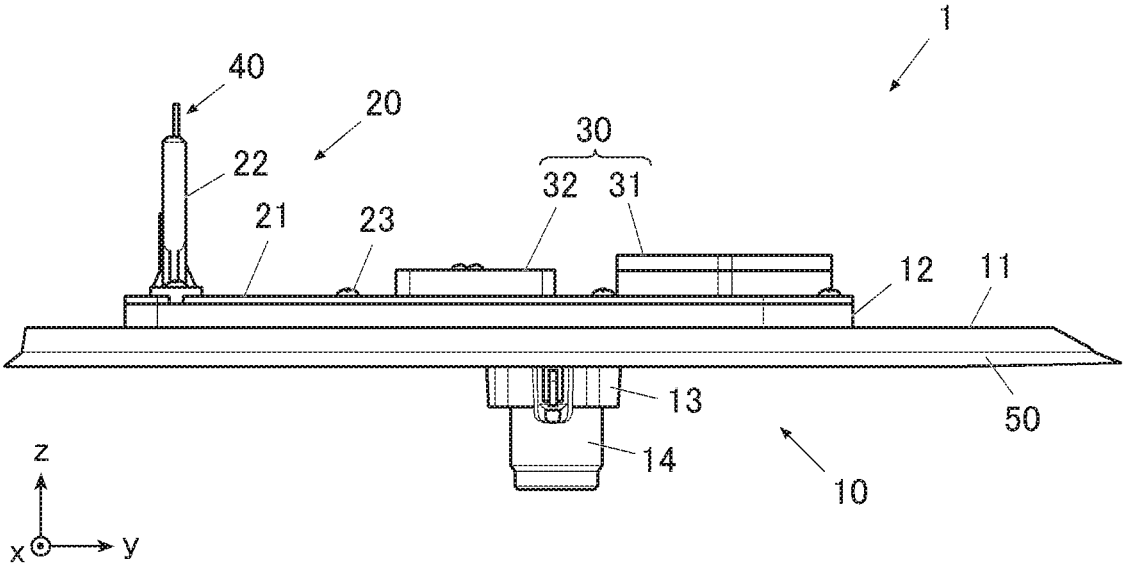
FIG. 1B is a side view showing the antenna device according to the embodiment.
Figure 2A:
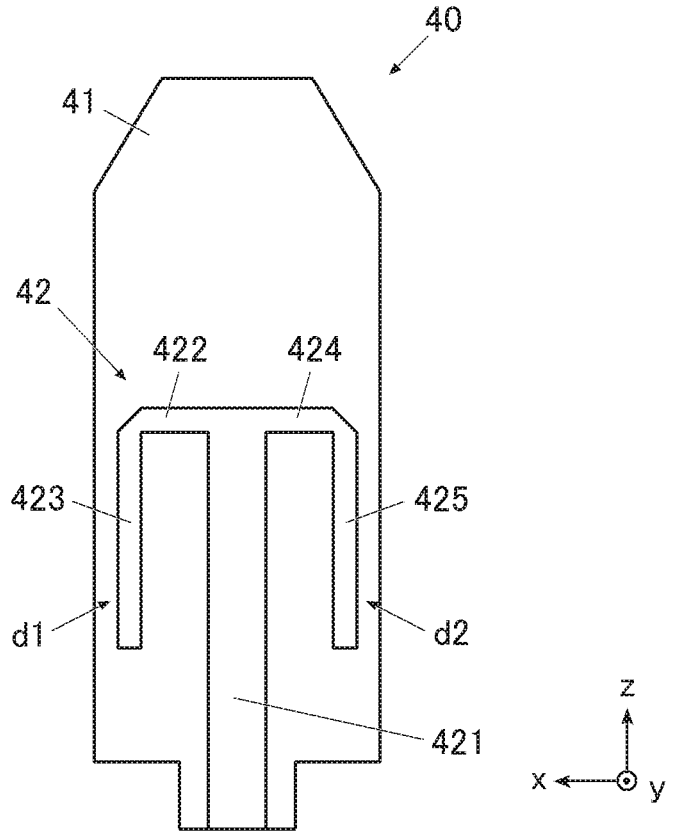
FIG. 2A is a plan view showing a front surface of a stacked dipole antenna unit.
Figure 2B:
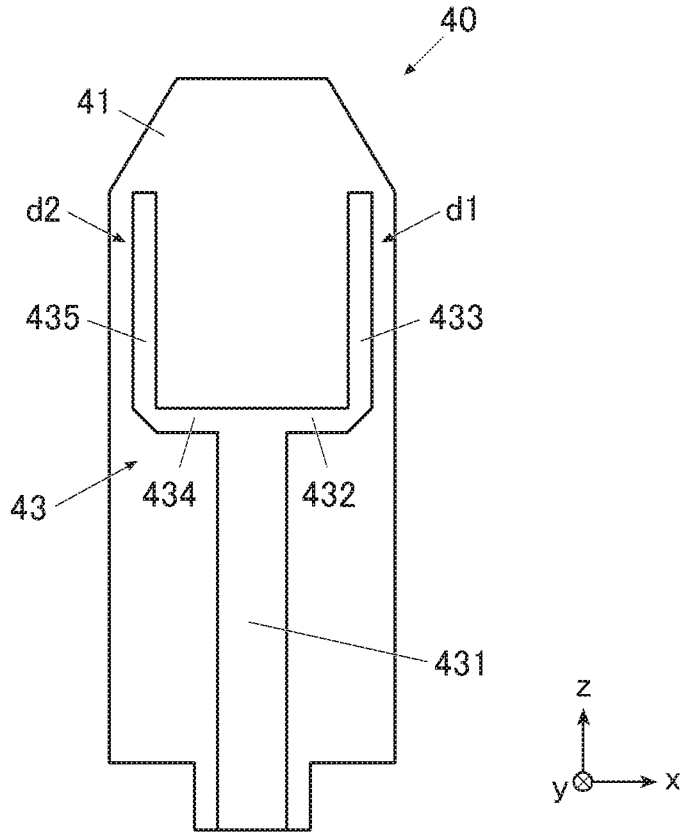
FIG. 2B is a plan view showing a back surface of the stacked dipole antenna unit.

An antenna device 1 according to an embodiment of the present invention will be described with reference to FIG. 1 to FIG. 8B. First, device configurations of the antenna device 1 will be described with reference to FIG. 1A to FIG. 2B. FIG. 1A is a perspective view showing the antenna device 1 of the present embodiment. FIG. 1B is a side view showing the antenna device 1. FIG. 2A is a plan view showing a front surface of a stacked dipole antenna unit 40. FIG. 2B is a plan view showing a back surface of the stacked dipole antenna unit 40.

The antenna device 1 shown in FIG. 1A and FIG. 1B is an in-vehicle antenna device capable of receiving a radio wave(s) having frequency bands corresponding to satellite radio broadcasting such as SDARS (Satellite Digital Audio Radio Service), GNSS (Global Navigation Satellite System) such as GPS, GLONASS (Global Navigation Satellite System), and Galileo, and V2V (V2X) communication. The antenna device 1 is fixed to and installed at a fixing opening (not shown) at an installation surface of a roof of a vehicle such as a motor vehicle. The fixing opening is, for example, a substantially square hole having sides of a predetermined length (for example, 15 mm).

As shown in FIG. 1A and FIG. 1B, the antenna device 1 of the present embodiment has an antenna cover (not shown), an antenna base 10, a substrate 20, an antenna unit 30, a stacked dipole antenna unit 40, and a gasket 50. Furthermore, as shown in FIG. 1A and FIG. 1B, an x axis is taken horizontally along a left-right direction of the vehicle, a y axis is taken horizontally along a front-back direction of the vehicle, and a z axis is taken vertically along a direction perpendicular to the horizontal plane, which are also applied to other drawings.

The antenna cover to be attached to the antenna base 10 is formed in a streamlined shape, rising from the front (+y direction) to the back (−y direction). More specifically, the antenna cover is formed in a low profile shark fin shape so as not to deteriorate appearances of the vehicle. The antenna cover is a molded product having an open bottom and is made of a synthetic resin that transmits radio waves and has an insulating property, for example, ABS (Acrylonitrile Butadiene Styrene) resin. The open bottom of the antenna cover forms a space for housing the substrate 20, the antenna unit 30, and the stacked dipole antenna unit 40 when attached to the antenna base 10 or the like.

The antenna base 10 is a base of the antenna device 1 on which the substrate 20, the antenna unit 30, and the stacked dipole antenna unit 40 are mounted, and has a structure to be attached to a fixing opening at the installation surface of the vehicle. The antenna base 10 is integrally formed by die-casting of metal such as aluminum, but is not limited to this. For example, at least a part of the antenna base 10 may be made of resin or a plate of metal such as steel.

The antenna base 10 includes a base body 11, a substrate installation unit 12, a guide 13, and a screw unit 14. The base body 11 is a flat base unit. The substrate installation unit 12 is provided in a convex manner on a flat portion of the base body 11 and forms a unit for installation of the substrate 20. The base installation unit 12 has a female screw hole(s) (not shown) into which a male screw(s) 23 (described below) are screwed.

The guide 13 guides the antenna device 1 to the fixing opening of the vehicle. The guide 13 is formed in a cuboid shape having substantially square surfaces corresponding to the fixing opening. The guide 13 is inserted into the fixing opening, and may have a claw and the like for temporary fixation.

The screw unit 14 is a bolt-shaped portion and has a slit along its shaft. Cables for the antenna unit 30 and the stacked dipole antenna unit 40 pass through the slit. One end of each of the cables is electrically connected to a substrate body 21 of the substrate 20, and the other end is electrically connected to a receiver inside the vehicle and the like. The screw unit 14 and the guide 13 are inserted into the fixing opening of the vehicle, where the screw unit 14 is fastened with an antenna fixing unit (not shown) such that the antenna device 1 is attached to the installation surface of the vehicle. The antenna fixing unit is made of metal, for example, and has a nut and a protrusion. The nut has a female screw corresponding to the screw unit 14 is formed there in. The protrusion comes into contact with the installation surface of the vehicle at the time of the fastening.

The substrate 20 includes the substrate body 21, an antenna holder 22, and the male screws 23. The substrate body 21 is a PCB (Printed Circuit Board) made of, for example, glass epoxy resin. The substrate body 21 has a patterned circuit formed thereon for the antenna unit 30 and the stacked dipole antenna unit 40. The antenna unit 30, the stacked dipole antenna unit 40, and various circuit elements are mounted on the substrate body 21. The substrate body 21 has a plurality of (for example, eight) screw holes through which the male screws 23 are screwed into the respective female screws of the base installation unit 12 so that the substrate body 21 is fixed to and installed at the base installation unit 12.

The antenna holder 22 is made of an insulating material such as resin. The antenna holder 22 is erected on the substrate body 21 and guides and holds the stacked dipole antenna unit 40 such that a surface of the stacked dipole antenna unit 40 is parallel to the xz plane.

The antenna unit 30 has patch antennas 31 and 32. The patch antenna 31 receives radio waves in the frequency band corresponding to SDARS to perform wireless communication, for example, and is mounted on the substrate body 21 such that one diagonal of the substantially square surface of the patch antenna 31 is in the x axis direction. The patch antenna 32 receives radio waves in the frequency band corresponding to GNSS to perform wireless communication, for example, and is mounted on the substrate body 21 such that one side of the substantially square surface of the patch antenna 32 is in the x axis direction. In this way, the patch antenna 31 and the patch antenna 32 are different from each other in the direction of their sides (diagonals) by 45°, so as not to interfere with each other in their antenna characteristics. The above wireless communication systems and the arrangement order in the y axis direction of the patch antennas 31 and 32 are merely examples, and the present invention is not limited to them.

The stacked dipole antenna unit 40 is a substrate-like antenna that transmits and receives radio waves for V2V communication (frequency band: 5.9 GHz band) that is different from the wireless communication by the antenna unit 30. The stacked dipole antenna unit 40 is fitted in the antenna holder 22 so as to have a surface parallel to the xz plane. The +y side surface and the −y side surface of the stacked dipole antenna unit 40 are respectively referred to as a front surface and a back surface.

The gasket 50 is made of an elastic material having waterproofness and chemical resistance such as petroleum rubber (for example, EPDM (Ethylene Propylene Diene Monomer)). The gasket 50 is provided around and on the lower surface of the base body 11 of the antenna base 10. When the screw unit 14 and the guide 13 are inserted into the fixing opening of the vehicle and fastened by the antenna fixing unit (not shown), the gasket 50 is compressed by being sandwiched between the base body 11 and the installation surface of the vehicle. As a result, the gasket 50 exhibits a waterproof and dustproof function by preventing water, dust, and the like from entering inside of the vehicle from the outside through the fixing opening of the vehicle.

The antenna device 1 is not limited to a shark fin antenna. For example, the antenna device 1 may be a rod antenna including an antenna unit 30 having an AM/FM radio broadcast antenna and a stacked dipole antenna unit 40 for V2X communication.

Next, a surface pattern of the stacked dipole antenna unit 40 will be described with reference to FIG. 2A and FIG. 2B. As shown in FIG. 2A and FIG. 2B, the stacked dipole antenna unit 40 includes an antenna substrate 41 and antenna element units 42 and 43. In the following descriptions, the antenna element unit 42 flows antenna current and the antenna element unit 43 is grounded, but they may be replaced with each other.

The antenna substrate 41 is a flat substrate made of an insulating material and supports the antenna element units 42 and 43. As shown in FIG. 2A, the antenna element unit 42 is a patterned conductor made of metal such as copper foil and formed on the front surface of the antenna substrate 41. The antenna element unit 42 includes antenna elements 421, 422, 423, 424, and 425.

The antenna element 421 has an end electrically connected to a terminal of the substrate body 21 and extends in the +z direction from the end to the other end. The antenna element 422 extends in the +x direction from its end that is connected to the +z side end of the antenna element 421. The antenna element 423 extends in the −z direction from its end that is connected to the +x side end of the antenna element 422. The antenna element 424 extends in the −x direction from its end that is connected to the +z side end of the antenna element 421. The antenna element 425 extends in the −z direction from its end that is connected to the −x side end of the antenna element 424.

As shown in FIG. 2B, the antenna element unit 43 is a patterned conductor made of metal such as copper foil and formed on the back surface of the antenna substrate 41. The antenna element unit 43 includes antenna elements 431, 432, 433, 434, and 435.

The antenna element 431 extends in the +z direction from its end that is electrically connected to a terminal of the substrate body 21. The antenna element 432 extends in the +x direction from its end that is connected to the +z side end of the antenna element 431. The antenna element 433 extends in the +z direction from its end that is connected to the +x side end of the antenna element 432. The antenna element 434 extends in the −x direction from its end that is connected to the +z side end of the antenna element 431. The antenna element 425 extends in the +z direction from its end that is connected to the −x side end of the antenna element 434.

The antenna elements 423 and 433 in the stacked dipole antenna unit 40 function as a dipole antenna d1. The antenna elements 423 and 433 extend in the z axis direction (up and down directions), and the +x side ends of the antenna elements 422 and 432 are feeding points of the antenna elements 423 and 433, respectively. The antenna elements 425 and 435 function as a dipole antenna d2. The antenna elements 425 and 435 extend in the z axis direction (up and down directions), and the −x side ends of the antenna elements 424 and 434 are feeding points of the antenna elements 425 and 435, respectively.

Furthermore, the dipole antennas d1 and d2 function as a stacked dipole antenna in which antenna elements are at a predetermined distance from each other and extend vertically and in parallel with each other.

Figure 3:
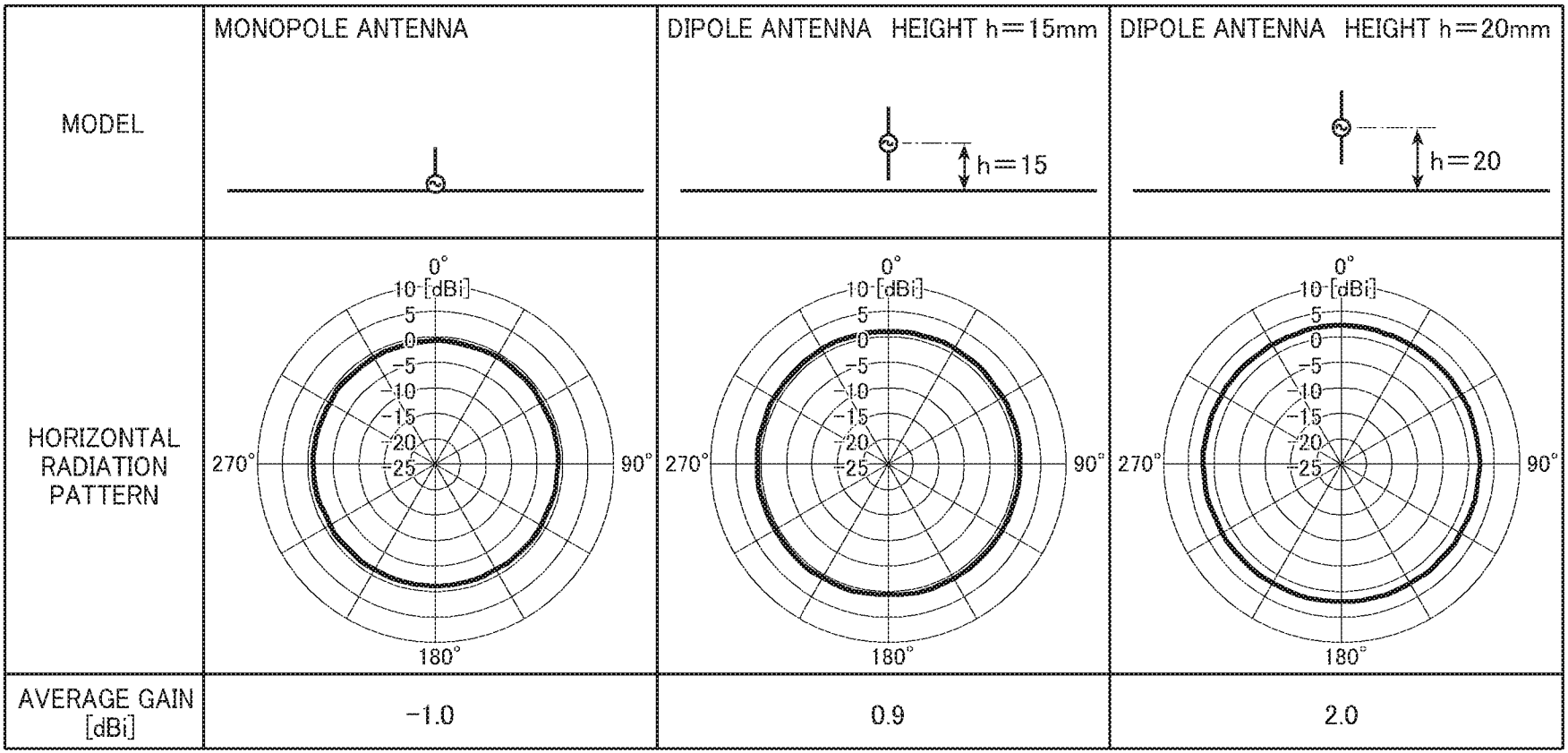
FIG. 3 is a diagram showing horizontal radiation patterns and average gains for models which each include a monopole antenna or a dipole antenna and where the feeding points are at different heights.
Figure 4:
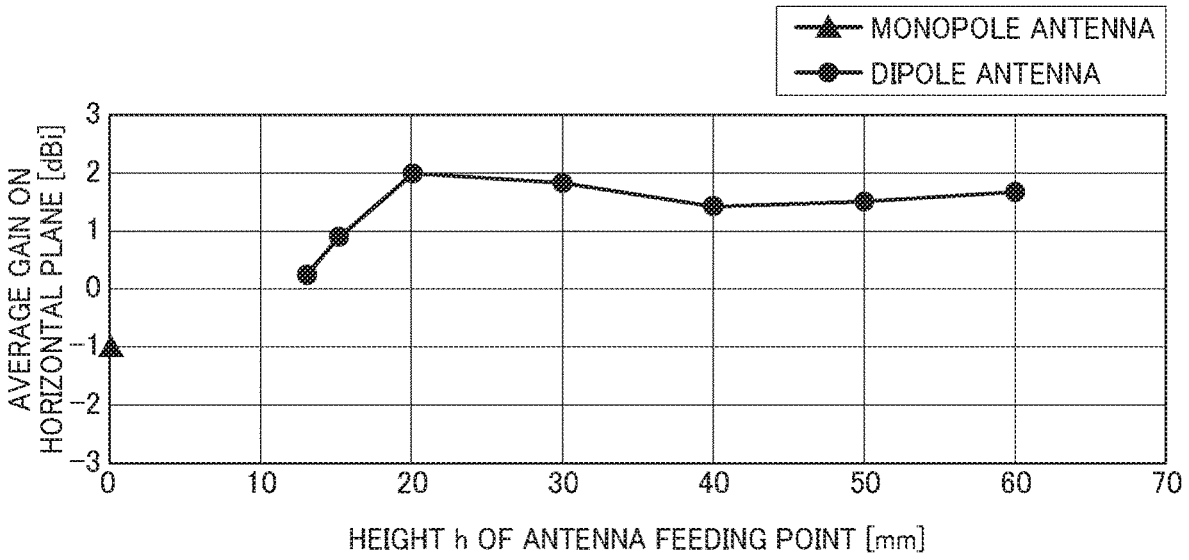
FIG. 4 is a diagram showing the average gain with respect to the height of the antenna feeding points of the monopole antenna and the dipole antennas.
Figure 5:
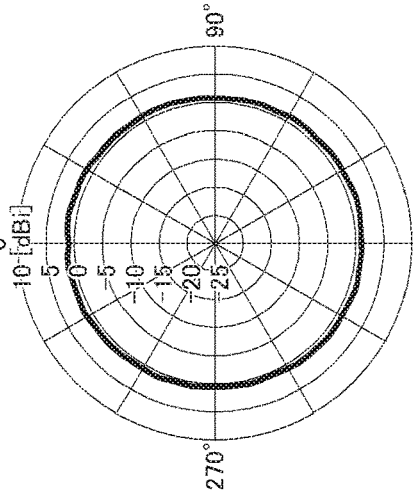
FIG. 5 is a diagram showing horizontal radiation patterns and antenna gains for models that include respective stacked dipole antennas and where the distance between the dipole antennas are different from each other.
Figure 5:
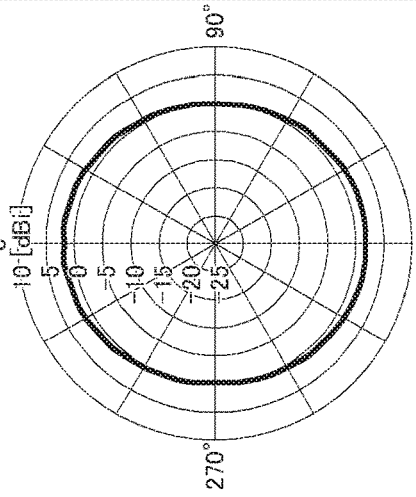
Figure 5:
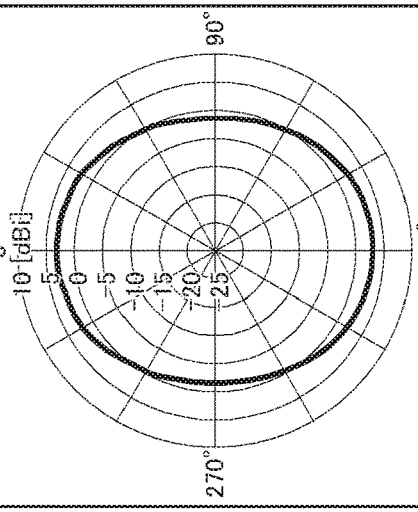
Figure 6:
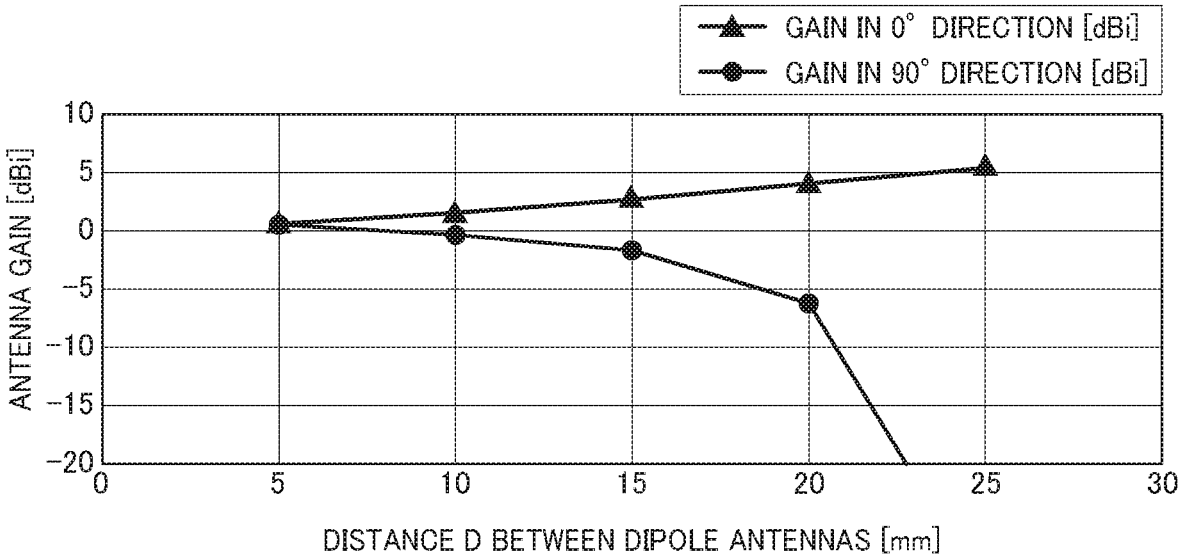
FIG. 6 is a diagram showing antenna gains for the respective stacked dipole antennas with respect to the distance between dipole antennas.
Figure 7:
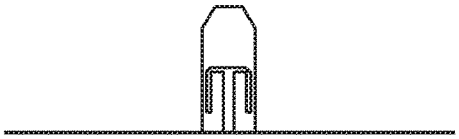
FIG. 7 is a diagram showing horizontal radiation patterns, antenna gains, and radiation patterns on vertical plane for models which each include a substrate-stacked dipole antenna and a monopole antenna.
Figure 7:
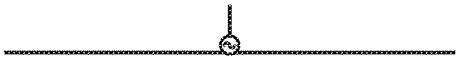
Figure 7:
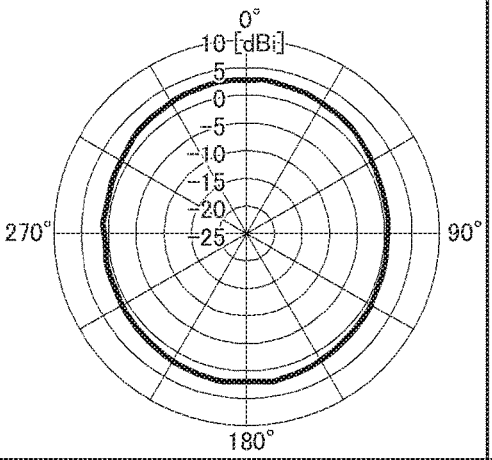
Figure 7:
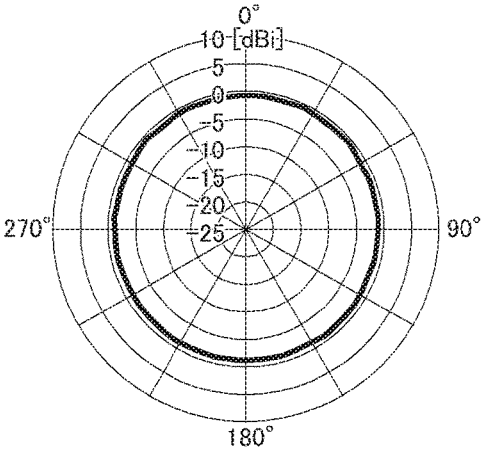
Figure 7:
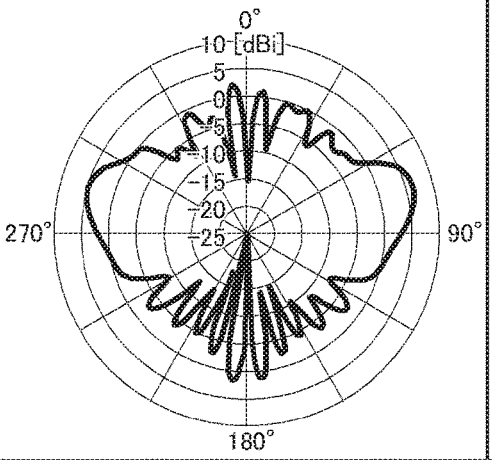
Figure 7:
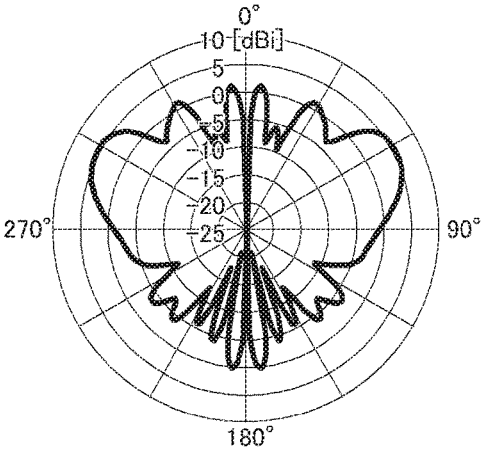

Next, with reference to FIG. 3 to FIG. 8, antenna characteristics of the stacked dipole antenna unit 40 in the antenna device 1 will be described. FIG. 3 is a diagram showing horizontal radiation patterns and average gains for models which each include a monopole antenna or a dipole antenna and where the feeding points are at different heights h. FIG. 4 is a diagram showing the average gain with respect to the height h of the antenna feeding points of the monopole antenna and the dipole antennas. FIG. 5 is a diagram showing horizontal radiation patterns and antenna gains for models that include respective stacked dipole antennas and where the distance D between the dipole antennas are different from each other. FIG. 6 is a diagram showing antenna gains for the respective stacked dipole antennas with respect to the distance D between dipole antennas. FIG. 7 is a diagram showing horizontal radiation patterns, antenna gains, and radiation patterns on vertical plane for models which each include a substrate-stacked dipole antenna and a monopole antenna.

As shown in FIG. 3, horizontal radiation patterns and average gains were simulated for models each including a monopole antenna or a dipole antenna. In the models, the heights h of the feeding points from the ground surface as a horizontal plane (for example, the substrate, base unit, and ground portion of the installation surface (roof) of the vehicle) were different from each other. The antenna elements of the monopole antenna and the dipole antenna of FIG. 3 extended in a direction that was perpendicular to the ground surface and were rotationally symmetric in the horizontal plane. The antenna element length of the dipole antenna was twice the antenna element length of the monopole antenna. An arbitrarily determined horizontal direction was set to the front direction of the vehicle for each of the monopole antenna and the dipole antennas. With this front direction set as a reference angle (0°), the horizontal radiation pattern was shown by degrees [° ] for each of the antennas.

As shown in FIG. 3, the height h of the feeding point of the monopole antenna from the ground surface was set to be 0 mm, and the height h of the feeding points of the dipole antennas from the ground surface were set differently from each other, i.e., 15 mm and 20 mm. The gain [dBi] of the horizontal radiation pattern was almost the same at all angles [°] for each of the monopole antenna and dipole antennas. As for the average gain [dBi] in the angle range of 0° to 360°, it was larger in the dipole antenna than in the monopole antenna.

As shown in FIG. 4, the average gains [dBi] were further simulated for respective dipole antennas having feeding points at the heights h of 13, 30, 40, 50, and 60 mm, in addition to 15 and 20 mm. The average gains [dBi] were obtained for the monopole antenna and the dipole antennas having feeding points at different heights h from each other. According to FIG. 4, the average gains of the dipole antenna whose feeding points were at heights h were larger than the average gain of the monopole antenna. Thus, as the height h of the dipole antenna is adjusted, the average gain [dBi] can be increased.

The received radio waves tend to be broken when the height h of the feeding point of the dipole antenna is too high, but tend to include too much components reflected by the ground surface when the height h is too low. Therefore, the height h is preferably within an appropriate range so that the average gain [dBi] becomes large. Furthermore, as for the structures, the antenna element of the dipole antenna contacts the installation surface when the height h is too low, but the antenna device 1 cannot accommodate the antenna element or needs to be have a large size when the height h is too high. In consideration of such gain and structural requirements, the height h of the feeding point of the dipole antenna is preferably in a range of 0.25λ to 1.0λ (practically about 12 to 51 mm), where Δ is the wavelength of radio wave for V2V communication at a frequency 5.9 GHz.

Next, as shown in FIG. 5, horizontal radiation patterns and antenna gains were simulated for models of respective stacked dipole antennas each including two dipole antennas similar to those in FIG. 3. In the models, the distance D between the two dipole antennas are different from each other. The height h of the feeding point from the ground surface of the stacked dipole antenna in FIG. 5 was set to 20 mm for each dipole antenna. In the horizontal radiation patterns of the stacked dipole antennas, the front direction (0°) and the back direction (180°) on the horizontal plane were determined to be perpendicular to a plane containing the antenna elements of the two dipole antennas of the stacked dipole antenna.

While omnidirectional horizontal radiation patterns were obtained with the dipole antenna of FIG. 3, directional horizontal radiation patterns with large gains in the front and back directions were obtained with the stacked dipole antenna of FIG. 5. The distances D between the two dipole antennas were set further differently between the stacked dipole antennas in FIG. 5, i.e., 5, 10, and 15 mm. FIG. 5 shows that, as the distance D between the two dipole antennas increased, the average gain [dBi] of the horizontal radiation pattern also increased. When the distance D between the two dipole antennas was small, the gains [dBi] of the horizontal radiation pattern were almost the same regardless of the angle [° ]. However, as the distance D increased, the ratio of the gain [dBi] in 0° or 180° direction to the gain [dBi] in 90° or 270° direction also increased.

The reason is considered as follows. When the distance D between the two dipole antennas of the stacked dipole antenna is larger, the in-phase radio waves in the front direction (0° direction) that are from the respective two dipole antennas further reinforce each other. The same applies to the radio waves in the back direction (180° direction). However, when the distance D between the two dipole antennas of the stacked dipole antenna becomes larger such that the radio waves in the right direction (90° direction) from the respective two dipole antennas are out-of-phase, the radio waves further cancel each other. The same applies to the radio waves in the left direction (270° direction).

Furthermore, as shown in FIG. 6, the antenna gains (i.e., the gain [dBi] in 0° direction and the gain [dBi] in 90° direction) were simulated for respective stacked dipole antennas where the distance D between the dipole antennas were 20 and 25 mm, in addition to 5, 10, and 15 mm. Referring to the antenna gains (the gain [dBi] in 0° direction and the gain [dBi] in 90° direction) of the stacked dipole antenna, the distance D is preferably 0.4λ or less (practically about 20 mm or less) such that the gain in 90° direction is not less than −5 dBi, where λ is the wavelength of radio wave for V2V communication at a frequency 5.9 GHz. When the gain in 90° direction is less than −5 dBi, there are problems in the inter-vehicle communication (communication with the vehicle(s) on the left or right side of itself). The distance D is more preferably around 10 mm, which provides a good balance of gains in the front and back directions and gains in the left and right directions.

Next, as shown in FIG. 7, horizontal radiation patterns, antenna gains (average gains [dBi], gains [dBi] in 0° direction, gains [dBi] in 90° direction, and gains [dBi] in 180° direction), and vertical (on the yz plane) radiation patterns (gain [dBi]) were simulated for models of a substrate-stacked dipole antenna and a monopole antenna for comparison. The substrate-stacked dipole antenna had an antenna substrate on which a stacked dipole antenna under the preferable conditions (height h=20 mm, distance D=10 mm) in FIG. 5 was formed. The monopole antenna was the same as the one shown in FIG. 3. In the radiation patterns on vertical plane for these antennas, the angle [° ] in the upward direction (+z direction) was set to 0°, the one in the front direction (+y direction) was set to 90°, the one in the downward direction (−z direction) was set to 18°, and the one in the back direction (−y direction) was set to 270°.

The horizontal radiation pattern and the antenna gains of the stacked dipole antenna unit 40 as the substrate-stacked dipole antenna were almost the same as the horizontal radiation pattern and the antenna gains of the stacked dipole antenna under the preferable conditions shown in FIG. 5.

According to the radiation pattern on vertical plane of the stacked dipole antenna unit 40 as the substrate-stacked dipole antenna, the gains [dBi] in the front and back directions of the stacked dipole antenna unit 40 (vehicle) were larger than those of the monopole antenna.

According to the above-described embodiment, the in-vehicle antenna device 1 installed in the vehicle includes the stacked dipole antenna unit 40 provided with the dipole antennas d1 and d2 arranged in parallel with the xz plane that are perpendicular to the front-back direction of the vehicle. As a result, the gain in the front and back directions of the vehicle can be increased compared to an antenna device including a monopole antenna or only one dipole antenna.

The stacked dipole antenna unit 40 has a flat antenna substrate 41 and antenna element units 42 and 43 respectively formed on the front and back surfaces of the antenna substrate 41. Therefore, it is possible to obtain antenna characteristics (horizontal gain) equivalent to a stacked dipole antenna having no antenna substrate, to simplify the structure, and to reduce the size of the stacked dipole antenna unit 40.

The antenna device 1 includes an antenna unit 30 (patch antennas 31, 32) as a second antenna unit(s) that performs wireless communication different from the one performed by the stacked dipole antenna unit 40. Therefore, the stacked dipole antenna unit 40 is less affected by the other antenna unit (antenna unit 30) than the monopole antenna is, and can exhibit improved antenna characteristics.

The wireless communication system by the stacked dipole antenna unit 40 is a V2V wireless communication system as the inter-vehicle communication. Because the stacked dipole antenna unit 40 results in increased gains in the front and back directions, it is possible to favorably perform wireless communication with the vehicle (s) in front of (in a front direction of) or behind (in a back direction of) the vehicle itself, particularly during travelling.

The height of the feeding points of the dipole antennas d1 and d2 from the ground surface of the stacked dipole antenna unit 40 is 0.25, or more and 1.0λ or less, where λ represents the wavelength of the radio wave. As a result, the stacked dipole antenna unit 40 results in increased average gains in the horizontal plane and can be easily manufactured and installed. Furthermore, the size of the stacked dipole antenna unit 40 (antenna device 1) can be reduced.

The distance between the dipole antennas d1 and d2 of the stacked dipole antenna unit 40 is 0.4λ or less, where λ represents the wavelength of the radio wave. As a result, the stacked dipole antenna unit 40 realizes increased gain in the front and back directions (in the y axis direction) on the horizontal plane and, at the same time, prevents reduction of gain in the left and right directions (in the x axis direction) on the horizontal plane. Therefore, the vehicle provided with the stacked dipole antenna unit 40 can perform inter-vehicle communication with the vehicle(s) on the side of itself.

First Modified Example

A first modified example of the above embodiment will be described with reference to FIG. 8A to FIG. 9. The antenna device according to this first modified example has a wave director in front of the stacked dipole antenna unit 40, which is different from the antenna device 1 according to the above embodiment.

The device configurations according to this first modified example will be described with reference to FIG. 8A and FIG. 8B. FIG. 8A is a perspective view showing an antenna device 1A according to the first modified example. FIG. 8B is a side view showing the antenna device 1A.

Figure 8A:
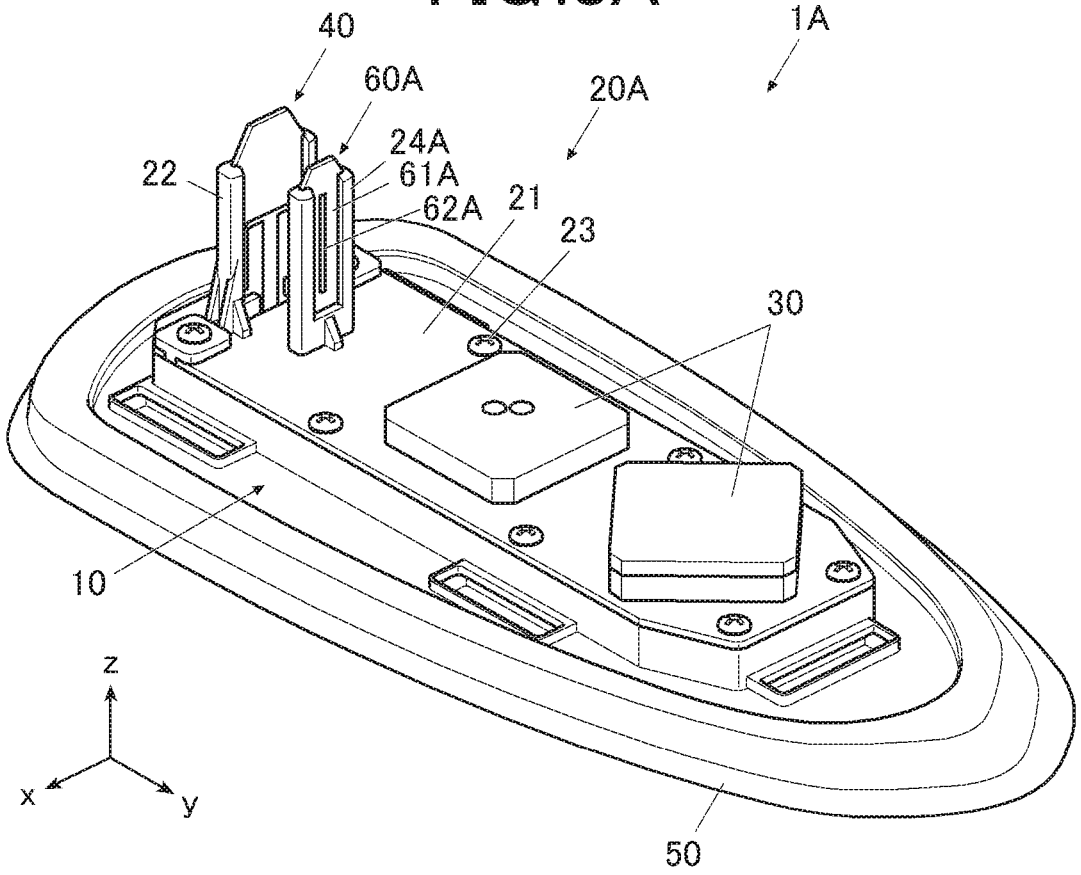
FIG. 8A is a perspective view showing an antenna device according to a first modified example.
Figure 8B:
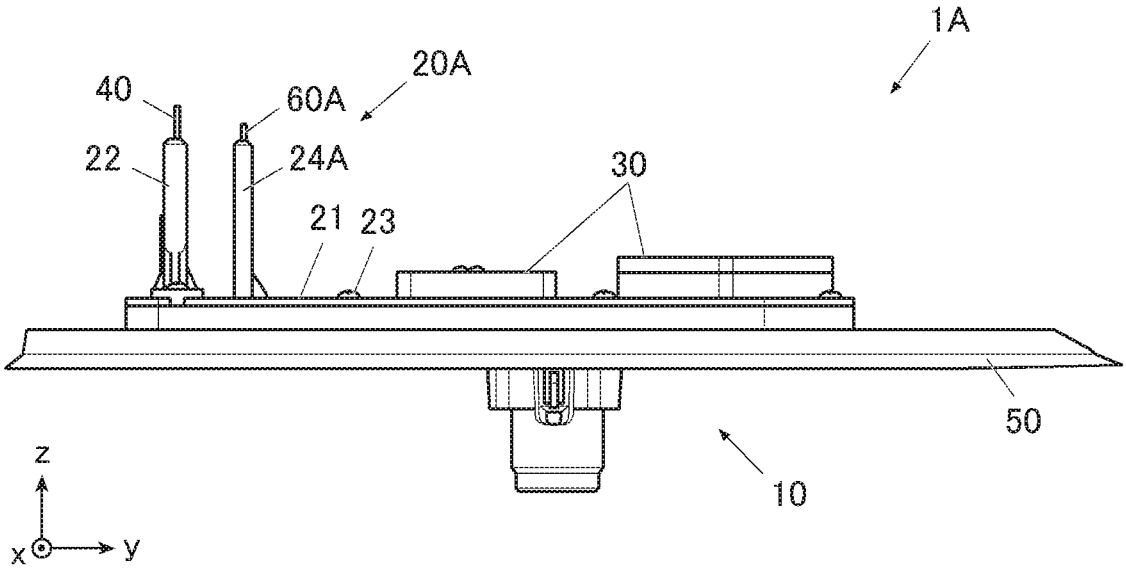
FIG. 8B is a side view showing the antenna device according to the first modified example.

The device configurations according to the first modified example include the antenna device 1A shown in FIG. 8A and FIG. 8B instead of the antenna device 1 of the above embodiment. The components of the antenna device 1A are denoted by the same reference numerals when they are the same as those of the antenna device 1, and are not described in the following description.

The antenna device 1A includes an antenna cover (not shown), the antenna base 10, a substrate 20A, the antenna unit 30, the stacked dipole antenna unit 40, the gasket 50, and a wave director 60A. The substrate 20A includes the substrate body 21, the antenna holder 22, the male screw(s) 23, and a wave director holder 24A.

The wave director holder 24A is made of an insulating material such as resin. The wave director holder 24A is erected on the substrate body 21 at a position in front of (on the +y side of) the antenna holder 22, and guides and holds the wave director 60A so as to have a surface parallel to the xz plane.

The wave director 60A is a flat wave director, and is fitted in the wave director holder 24A so as to have a surface parallel to the xz plane. The +y side surface and the −y side surface of the wave director 60A are respectively referred to as a front surface and a back surface.

The wave director 60A has a wave director substrate 61A and a conducting unit 62A. The wave director substrate 61A is a flat substrate made of an insulating material and supports the conducting unit 62A. As shown in FIG. 8A, the conducting unit 62A is a patterned conductor made of metal such as copper foil as a conductor, formed on the surface of the wave director substrate 61A, and extending in the z axis direction.

Next, with reference to FIG. 9, antenna characteristics of the stacked dipole antenna unit 40 in the antenna device 1A will be described. FIG. 9 is a diagram showing horizontal radiation patterns and antenna gains for models which each include a stacked dipole antenna unit 40 and a wave director 60A and where the conducting unit 62A of the first modified example has different lengths RL.

Figure 9:
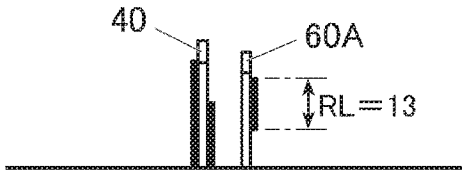
FIG. 9 is a diagram showing horizontal radiation patterns and antenna gains for models which each include a stacked dipole antenna unit and a wave director and where the conducting unit of the first modified example has different lengths.
Figure 9:
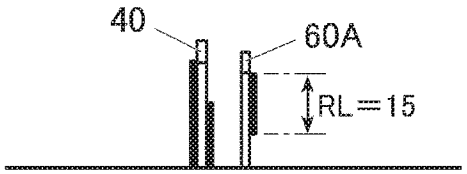
Figure 9:
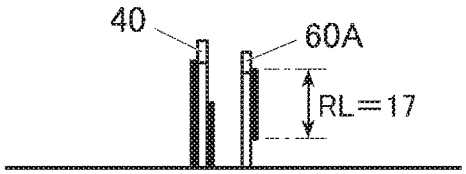
Figure 9:
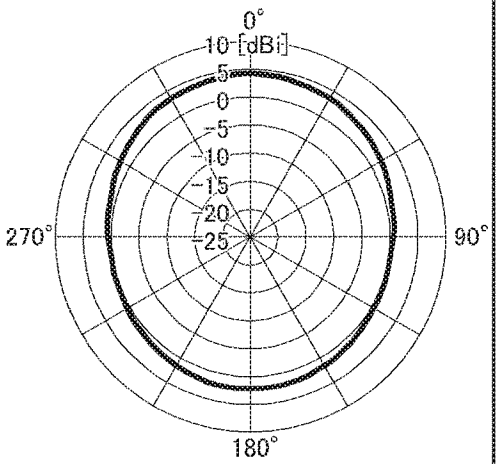
Figure 9:
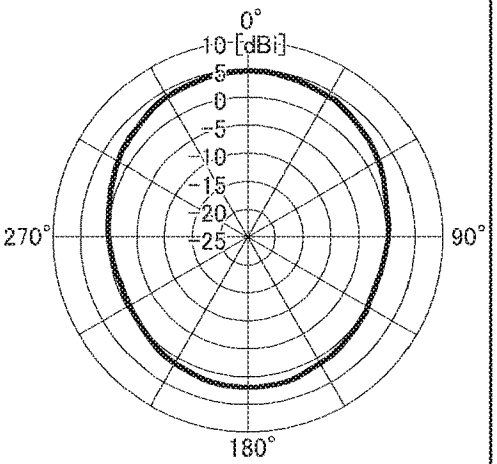
Figure 9:
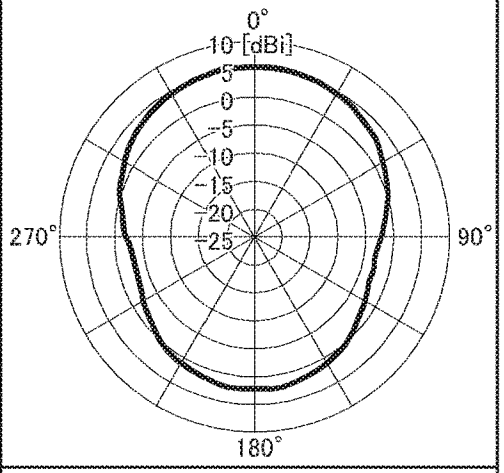

As shown in FIG. 9, horizontal radiation patterns and antenna gains (average gains [dBi], gains [dBi] in 0° direction, gains [dBi] in 90° direction, and gains [dBi] in 180° direction) were simulated for models of the stacked dipole antenna unit 40 (as in FIG. 7, the height of the feeding point of the dipole antennas are 20 mm and the distance D of the dipole antennas is 10 mm) and the wave director 60A. The lengths RL of the conducting unit 62A in the z axis direction were different between the models. The horizontal radiation patterns and the antenna gains were compared between the stacked dipole antenna unit 40 with the wave director 60A and the substrate-stacked dipole antenna (stacked dipole antenna unit 40) of FIG. 7. The average gain [dBi], specifically the gain [dBi] in 0° direction (corresponding to the front direction), was remarkably large when the stacked dipole antenna unit 40 was with the wave director 60A.

Furthermore, the lengths RL of the conducting unit 62A of the stacked dipole antenna unit with the wave director 60A were set differently from each other, i.e., 13, 15, and 17 mm, which revealed that the longer the length RL of the conducting unit 62A, the larger the gain [dBi] in the front direction. That is, the gain in the front direction of the stacked dipole antenna unit 40 can be tuned for each vehicle depending on usage of the wave director 60A and by changing the length RL of the conducting unit 62A. For example, in a vehicle having a sunroof or the like, the gain in the front direction tends to be small when the stacked dipole antenna unit 40 is used alone. In such a vehicle, the gain of the stacked dipole antenna unit 40 in the front direction can be compensated to a required value by including the wave director 60A and by increasing the length RL of the conducting unit 62A.

As described above, according to the first modified example, the antenna device 1A includes the wave director 60A arranged at a position in front of (in the +y direction of) the stacked dipole antenna unit 40. Therefore, the wave director 60A can further increase the gain of the stacked dipole antenna unit 40 in the front direction (+y direction).

The wave director 60A includes the flat wave director substrate 61A and the conducting unit 62A that is formed on the wave director substrate 61A and extends in the z axis direction (in parallel to the extending direction of the dipole antennas d1 and d2). This makes it possible to simplify the structure of the wave director 60A. Furthermore, by changing the length of the conducting unit 62A, the gain of the stacked dipole antenna unit 40 in the front direction (+y direction) can be freely adjusted for each vehicle.

Second Modified Example

A second modified example of the above embodiment will be described with reference to FIG. 10A to FIG. 11. The antenna device according to this second modified example has a wave director behind the stacked dipole antenna unit 40, which is different from the antenna device 1 according to the above embodiment.

The device configuration according to this second modified example will be described with reference to FIG. 10A and FIG. 10B. FIG. 10A is a perspective view showing an antenna device 1B according to the second modified example. FIG. 8B is a side view showing the antenna device 1B.

Figure 10A:
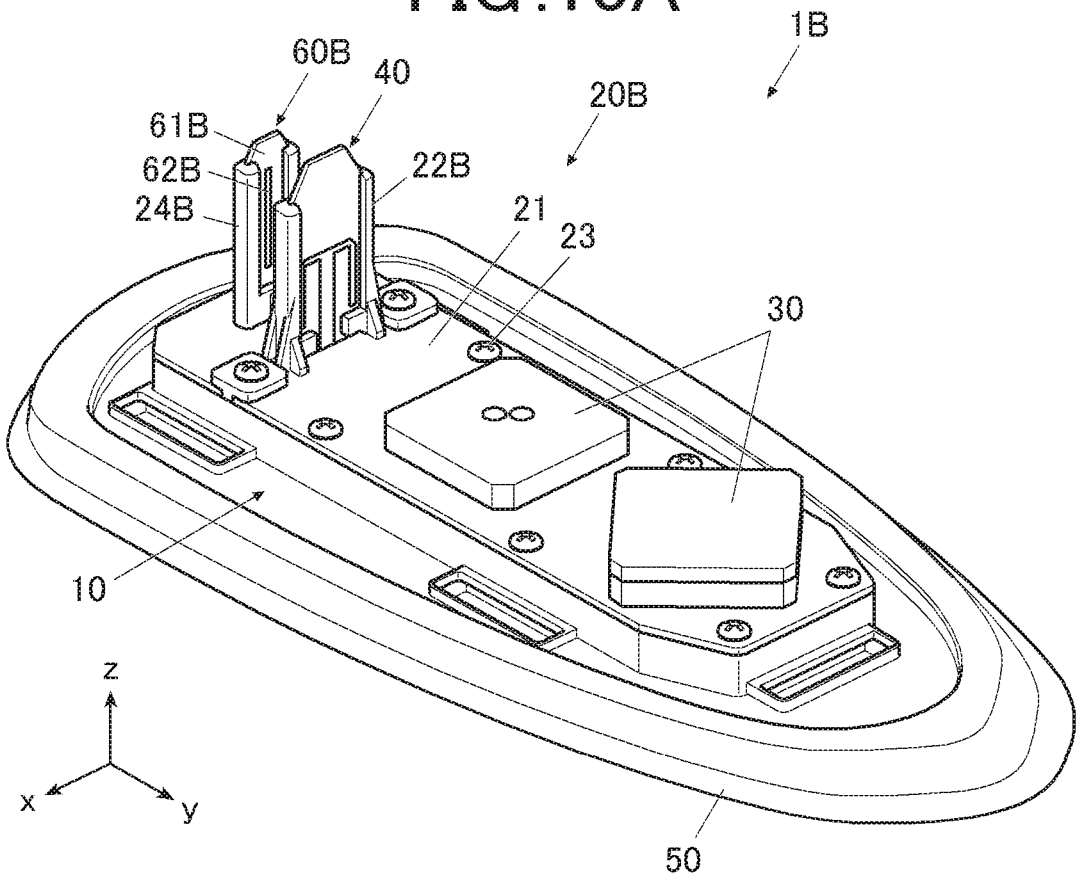
FIG. 10A is a perspective view showing an antenna device according to a second modified example.
Figure 10B:
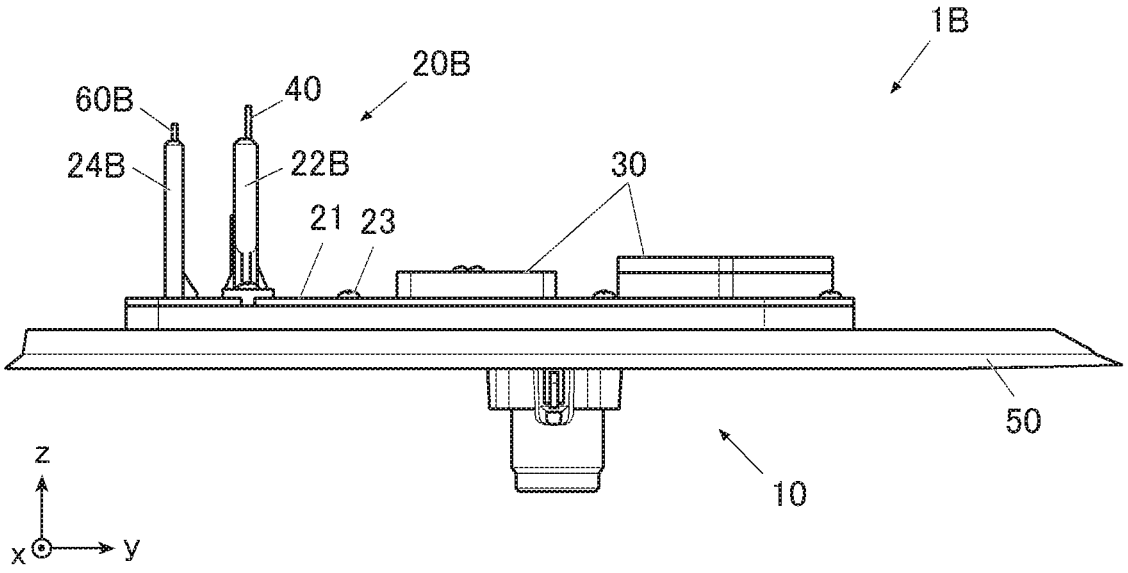
FIG. 10B is a side view showing the antenna device according to the second modified example.

The device configurations according to the second modified example include the antenna device 1B shown in FIG. 10A and FIG. 10B instead of the antenna device 1 of the above embodiment. The components of the antenna device 1B are denoted by the same reference numerals when they are the same as those of the antenna device 1, and are not described in the following description.

The antenna device 1B includes an antenna cover (not shown), the antenna base 10, a substrate 20B, the antenna unit 30, the stacked dipole antenna unit 40, the gasket 50, and a wave director 60B. The substrate 20B includes the substrate body 21, the antenna holder 22, the male screw(s) 23, and a wave director holder 24B.

The antenna holder 22B is the same as the antenna holder 22 of the above embodiment, but is arranged at a position in front of (in the +y direction of) the position of the antenna holder 22.

The wave director holder 24B is the same as the wave director holder 24A of the above first modified example, but is arranged on the substrate body 21 at a position behind (in the −y direction of) the antenna holder 22B (for example, at the position of the antenna holder 22 in the above embodiment). The wave director 60B is the same as the wave director 60A, and includes a wave director substrate 61B and a conducting unit 62B.

Next, with reference to FIG. 11, antenna characteristics of the stacked dipole antenna unit 40 in the antenna device 1B will be described. FIG. 11 is a diagram showing horizontal radiation patterns and antenna gains for models which each include a stacked dipole antenna unit 40 and a wave director 60B and where the conducting unit 62B of the second modified example has different lengths RL.

Figure 11:
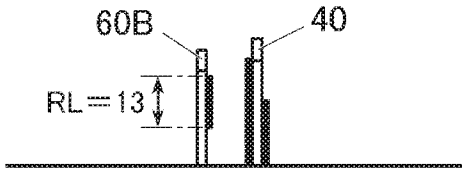
FIG. 11 is a diagram showing horizontal radiation patterns and antenna gains for models which each include a stacked dipole antenna unit and a wave director and where the conducting unit of the second modified example has different lengths.
Figure 11:
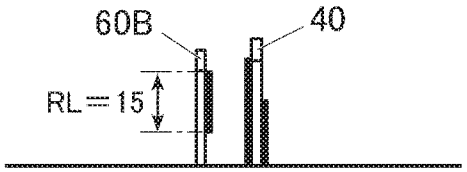
Figure 11:
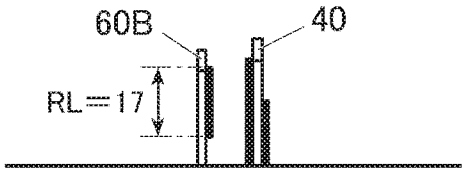
Figure 11:
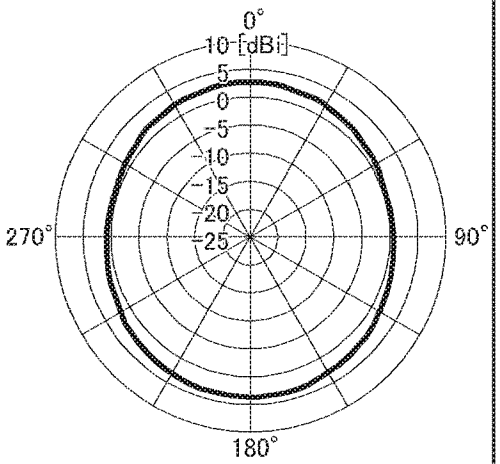
Figure 11:
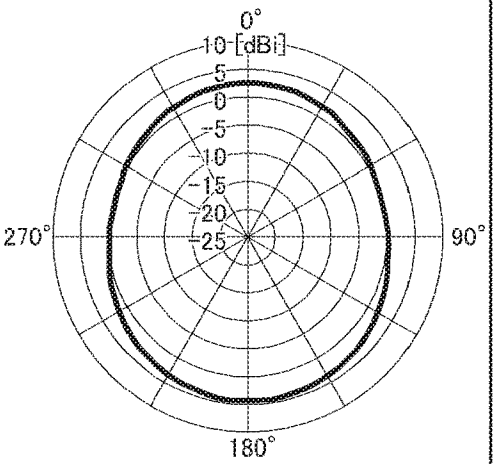
Figure 11:
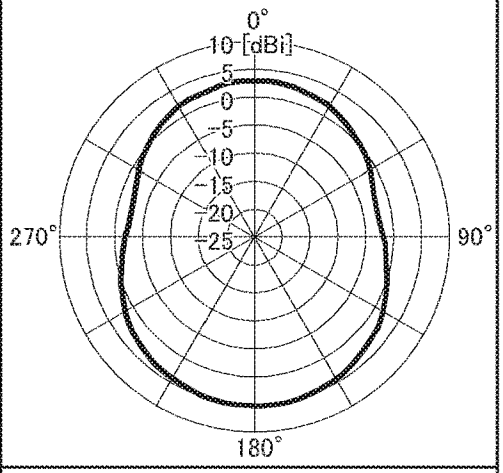

As shown in FIG. 11, horizontal radiation patterns and antenna gains (average gains [dBi], gains [dBi] in 0° direction, gains [dBi] in 90° direction, and gains [dBi] in 180° direction) were simulated for models of the stacked dipole antenna unit 40 (as in FIG. 7, the heights h of the feeding point of the dipole antennas were 20 mm and the distances D of the dipole antennas were 10 mm) and the wave director 60B. The lengths RL of the conducting unit 62B in the z axis direction were different between the models. The horizontal radiation patterns and the antenna gains were compared between the stacked dipole antenna unit 40 with the wave director 60B and the substrate-stacked dipole antenna (stacked dipole antenna unit 40) of FIG. 7. The average gain [dBi], specifically the gain [dBi] in the 0° direction (corresponding to the back direction), was remarkably large when the stacked dipole antenna unit 40 was with the wave director 60B.

Furthermore, the lengths RL pf the conducting unit 62B of the stacked dipole antenna unit with the wave director 60B were set differently from each other, i.e., 13, 15, and 17 mm, which revealed that the longer the length RL of the conducting unit 62B, the larger the gain [dBi] in the back direction. That is, the gain in the front direction of the stacked dipole antenna unit 40 can be tuned for each vehicle by using the wave director 60B or not and by changing the length RL of the conducting unit 62B. For example, in a vehicle having a rear spoiler or the like, the gain in the back direction tends to be small when the stacked dipole antenna unit 40 is used alone. In such a vehicle, the gain of the stacked dipole antenna unit 40 in the back direction can be compensated to a required value by including the wave director 60B and by increasing the length RL of the conducting unit 62B.

As described above, according to the second modified example, the antenna device 1B includes the wave director 60B arranged at a position behind (in the −y direction of) the stacked dipole antenna unit 40. Therefore, the wave director 60B can further increase the gain of the stacked dipole antenna unit 40 in the back direction (−y direction).

The wave director 60B includes the flat wave director substrate 61B and the conducting unit 62B that is formed on the wave director substrate 61B and extends in the z axis direction (in parallel to the extending direction of the dipole antennas d1 and d2). This makes it possible to simplify the structure of the wave director 60B. Furthermore, by changing the length of the conducting unit 62B, the gain of the stacked dipole antenna unit 40 in the back direction (−y direction) can be freely adjusted for each vehicle.

The above-described embodiment and modified examples are merely examples of the antenna device according to the present invention, and the present invention is not limited thereto. However, when the antenna device 1 includes both the wave directors 60A and 60B, ripples may occur in the horizontal radiation pattern.

Furthermore, the detailed configuration and the detailed operation of the antenna devices 1, 1A, and 1B in the above embodiment and the modified examples can be appropriately changed without departing from the spirit of the present invention.

What is claimed is:

1. An antenna device installable in a vehicle, said antenna device comprising:

a stacked dipole antenna unit including a plurality of dipole antennas arranged parallel to a plane perpendicular to a front-back direction of the vehicle, wherein:

the stacked dipole antenna unit further comprises a flat antenna substrate that has a front surface and a back surface, each of the front and back surfaces being provided with an antenna element unit;

each of the antenna element units comprises antenna elements; and one of the antenna elements on the front surface and one of the antenna elements on the back surface function as one of the dipole antennas.

2. The antenna device according to claim 1, further comprising:

a second antenna unit, wherein the stacked dipole antenna unit and the second antenna unit perform wireless communication different from each other.

3. The antenna device according to claim 1, wherein:

the stacked dipole antenna unit performs wireless communication between vehicles.

4. The antenna device according to claim 1, wherein:

a height of a feeding point of each of the dipole antennas from a ground surface is 0.25λ or more and 1.0λ or less, where λ represents a wavelength of a radio wave that is received by the stacked dipole antenna unit.

5. The antenna device according to claim 1, wherein:

a distance between the dipole antennas is 0.4λ or less, where λ represents a wavelength of a radio wave that is received by the stacked dipole antenna unit.

6. The antenna device according to claim 1, further comprising:

a wave director that is arranged at a front position or at a back position of the stacked dipole antenna unit.

7. The antenna device according to claim 6, wherein:

the wave director has a flat wave director substrate and a conducting unit, and the conducting unit is formed on the wave director substrate and extends in a direction that is parallel to an extending direction of the dipole antennas.

* * * * *